US011022258B2

(12) United States Patent
Deng et al.

(10) Patent No.: US 11,022,258 B2
(45) Date of Patent: Jun. 1, 2021

(54) SSL LAMP FOR REPLACING GAS DISCHARGE LAMP

(71) Applicant: SIGNIFY HOLDING B.V., Eindhoven (NL)

(72) Inventors: Lan Deng, Shanghai (CN); Li Wang, Eindhoven (NL)

(73) Assignee: SIGNIFY HOLDING B.V., Eindhoven (NL)

( * ) Notice: Subject to any disclaimer, the term of this patent is extended or adjusted under 35 U.S.C. 154(b) by 0 days.

(21) Appl. No.: 16/462,285

(22) PCT Filed: Nov. 23, 2017

(86) PCT No.: PCT/EP2017/080181

§ 371 (c)(1),
(2) Date: May 20, 2019

(87) PCT Pub. No.: WO2018/096027

PCT Pub. Date: May 31, 2018

(65) Prior Publication Data

US 2019/0368669 A1 Dec. 5, 2019

(30) Foreign Application Priority Data

Mar. 6, 2017 (EP) ..... 17159360

(51) Int. Cl.
*F21K 9/65* (2016.01)
*F21K 9/90* (2016.01)
(Continued)

(52) U.S. Cl.
CPC ..... *F21K 9/65* (2016.08); *F21K 9/90* (2013.01); *F21Y 2103/33* (2016.08); *F21Y 2107/30* (2016.08)

(58) Field of Classification Search
CPC ..... F21K 9/65; F21K 9/90; F21K 9/23; F21K 9/232; F21K 9/60; F21Y 2103/33; F21Y 2107/30
See application file for complete search history.

(56) References Cited

U.S. PATENT DOCUMENTS 8,953,926 B1 2/2015 Kelly et al.
9,080,733 B2 * 7/2015 Rowley ..... F21K 9/90
(Continued)

FOREIGN PATENT DOCUMENTS

EP 2292973 B1 3/2011
EP 2330345 A2 6/2011
(Continued)

*Primary Examiner* — Mariceli Santiago
(74) *Attorney, Agent, or Firm* — Daniel J. Piotrowski

(57) ABSTRACT

A solid state lighting lamp (10) for replacing a gas discharge lamp (1) having a light emission area (3) with a given light center length (A) and a given light emission area length (B) is disclosed. The solid state lighting lamp comprises a base portion (11) including a connector (12); an upper portion (13) opposite said base portion; and a plurality of linear arrays of solid state lighting sources (17) mounted on a body (21) and extending in parallel with a central axis (30) of the lamp, each linear array having a central point within 10% tolerance of the given light center length from the connector, wherein, for each linear array: an upper solid state lighting source (17*a*) lies on an upper virtual conical surface (30) extending from a point of said central axis coinciding with an upper edge of the light emission area under a first internal angle (α) between said central axis and the upper virtual conical surface in a range 40-85°; and a lower solid state lighting source (17*b*) lies on a lower virtual conical surface (40) extending from a further point of said central axis coinciding with a lower edge of the light emission area under a second internal angle (β) between said central axis and the
(Continued)

lower virtual conical surface in a range 40-85°. A luminaire comprising such a solid state lighting lamp is also disclosed.

15 Claims, 9 Drawing Sheets

(51) Int. Cl.
*F21Y 103/33* (2016.01)
*F21Y 107/30* (2016.01)

(56) References Cited

U.S. PATENT DOCUMENTS 9,243,758 B2 * 1/2016 Pickard ..... F21V 29/83
9,664,339 B2 * 5/2017 Bittinger ..... F21S 41/192
2004/0195947 A1 10/2004 Clark et al.
2005/0030761 A1 * 2/2005 Burgess ..... F21K 9/232 362/555
2009/0116233 A1 * 5/2009 Zheng ..... F21V 29/75 362/234
2010/0213809 A1 * 8/2010 Roehl ..... F21S 45/47 313/46
2011/0254423 A1 * 10/2011 Lee ..... F21K 9/232 313/46
2014/0362568 A1 * 12/2014 Su ..... F21K 9/232 362/235
2015/0036341 A1 * 2/2015 Ge ..... F21V 3/061 362/240
2015/0078005 A1 * 3/2015 Renn ..... F21V 23/007 362/294
2015/0103525 A1 4/2015 Rowley et al.
2016/0161103 A1 6/2016 Ramaiah et al.
2017/0198875 A1 * 7/2017 Creusen ..... F21S 41/32
2018/0031208 A1 * 2/2018 Bukkems ..... F21V 14/02
2019/0331333 A1 * 10/2019 Bukkems ..... F21K 9/23

FOREIGN PATENT DOCUMENTS

EP 2937624 A1 10/2015
JP 2013123027 A * 6/2013 ..... F21K 9/90
WO 2020024583 A2 3/2010
WO WO-2010023223 A1 * 3/2010 ..... F21K 9/232
WO 2013007815 A1 1/2013
WO 2014134850 A1 9/2014

* cited by examiner

10

SSL LAMP FOR REPLACING GAS DISCHARGE LAMP

CROSS-REFERENCE TO PRIOR APPLICATIONS

This application is the U.S. National Phase application under 35 U.S.C. § 371 of International Application No. PCT/EP2017/080181, filed on Nov. 23, 2017, which claims the benefit of Chinese Patent Application No. PCT/CN2016/107328, filed on Nov. 25, 2016 and European Patent Application No. 17159360.1. These applications are hereby incorporated by reference herein.

FIELD OF THE INVENTION

The present invention relates to a solid state lighting (SSL) lamp for replacing a gas discharge lamp such as a high-pressure sodium (HPS) lamp with a given light centre length and a given light emission area length.

The present invention further relates to a luminaire comprising such a SSL lamp.

BACKGROUND OF THE INVENTION

Modern society is witnessing a shift towards solid state lighting applications such as LED applications. Such applications have improved longevity, e.g. through improved robustness against accidental impacts, and superior energy consumption characteristics compared to traditional light sources such as incandescent and halogen light sources. One such an application domain is outdoor lighting, where traditionally HPS and high-intensity discharge (HIS) lamps have been used to illuminate outdoor areas, e.g. public outdoor areas such as streets, squares, motorways and so on.

In some jurisdictions such as the US, such lighting devices are required to produce a lighting distribution of a particular shape at least in the horizontal plane, such as the ANSI RP-8-14 in the US, which defines a number of different light distributions (e.g. Type I-V light distributions). These different light distributions for instance are to facilitate meeting different residents' requirements regarding outdoor light distributions in the vicinity of their place of residency. In order to achieve the different light distributions, luminaires are typically fitted with reflectors or specially designed optical structures.

Due to the intrinsically different principle of generation of light in a gas discharge lamp such as an HPS lamp, which typically comprises a burner that generates omnidirectional light, and SSL sources, which typically generate light having a Lambertian distribution and act more like a point light sources, it is far from trivial to produce a luminous distribution with a SSL lamp designed to replace such a gas discharge lamp that closely resembles the luminous distribution of the gas discharge lamp. Consequently, such replacement SSL lamps are typically incapable of generating the mandatory luminous distribution, such as for example a Type V luminous distribution as specified in the ANSI RP-8-14 roadway lighting standard, when placed in a luminaire that is designed to generate such a luminous distribution when used in conjunction with the appropriate gas discharge lamp.

U.S. 2015/0078005 A1 discloses a solid-state lighting device for use in lieu of a gas discharge lamp. The SSL lighting device includes a housing, a lens coupled to the housing, a circuit board and a plurality of solid-state light emitters carried by the circuit board and arranged to generate light to pass through the lens. An entirety of a form factor of the solid-state lighting device is located within a cylindrical envelope having a length less than or about equal to an overall length of the gas discharge lamp and a diameter less than or about equal to the overall diameter of the gas discharge lamp. In addition, a light center length of the solid-state lighting device may be about equal to the light center length of the gas discharge lamp. Solid-state light emitters are arrayed with principal axes of emission radially spaced at least partially around and extending from a central axis of the lens. Such a radial arrangement of solid-state light emitters is relatively costly, and difficult to scale, e.g. to increase the luminous flux of the solid-state lighting device by adding more solid-state light emitters.

SUMMARY OF THE INVENTION

The present invention seeks to provide a more cost-effective solid state lighting lamp capable of producing a luminous distribution closely resembling the luminous distribution of a gas discharge lamp, e.g. a HPS lamp, it targets to replace.

The present invention seeks to provide a luminaire comprising such a solid state lighting lamp.

According to an aspect, there is provided a solid state lighting lamp for replacing a gas discharge lamp having a light emission area with a given light center length and a given light emission area length, which gas discharge lamp is compliance with ANSI ANSLGC78.42-2009, the solid state lighting lamp comprising a base portion including a connector; an upper portion opposite said base portion; and a plurality of linear arrays of solid state lighting sources mounted on a body and extending in parallel with a central axis of the lamp, each linear array having a central point within 10% tolerance of the given light center length from the connector, wherein, for each linear array an upper solid state lighting source lies on an upper virtual conical surface extending from a point of said central axis coinciding with an upper edge of the light emission area under a first internal angle between said central axis and the upper virtual conical surface in a range 40-85°; and a lower solid state lighting source lies on a lower virtual conical surface extending from a further point of said central axis coinciding with a lower edge of the light emission area under a second internal angle between said central axis and the lower virtual conical surface in a range 40-85°. The distance between the point and the further point of said central axis is the given light emission area length.

The inventors have realized that a SSL lamp having the above geometrical relationship with a gas discharge lamp having a given light centre length and light emission area dimensions achieves a luminous distribution that is comparable to the luminous distribution of the gas discharge lamp, such that the SSL lamp can be used as a suitable replacement of the gas discharge lamp given that it has a similar appearance in terms of luminous distribution as the gas discharge lamp, which renders the SSL lamp aesthetically acceptable to most users.

Preferably, the first internal angle and the second internal angle are individually selected from a range of 77-83° as this gives a particularly close match between the luminous distribution of the gas discharge lamp and the luminous distribution of the SSL lamp according to this embodiment. For the same reason, the first internal angle and the second internal angle preferably are the same.

Also, each linear array preferably has a central point within 5% tolerance of the given light center length from the connector in order to achieve a close match between the luminous distributions of the gas discharge lamp and the SSL lamp respectively.

Each linear array may have a length exceeding the given light emission area length by at least 30% without compromising the similarity between the respective luminous distributions of the gas discharge lamp and the SSL lamp. This is surprising given that previously it was generally accepted that the distribution of SSL sources should be contained as closely as possible within the burner area of the corresponding gas discharge lamp in order to achieve such a similarity.

In an embodiment, the body is formed of separate optical modules, each carrying one of said linear arrays. Such a modular body facilitates assembly of the SSL lamp, thereby reducing its cost.

Preferably, the body is made of a thermally conductive material such as aluminium and arranged to act as a heat sink for the solid state lighting sources. This obviates the need for a separate heat sink, thereby reducing the number of required components and reducing the cost of the SSL lamp as a result.

The body may delimit an inner volume of the solid state lighting lamp, said inner volume comprising a driver circuit for the solid state lighting sources. This yields a particularly compact design as the driver circuit may be hidden in a central void of the SSL lamp.

In an embodiment, the body comprises a plurality of channels, each linear array of solid state lighting sources being mounted in one of said channels. This has the further advantage that the channels may assist in shaping the luminous output of each linear array of SSL sources, for example by making at least the sidewalls of the channels reflective.

According to another aspect, there is provided a luminaire for use with a gas discharge lamp having a given light center length and a given light emission area length, the luminaire comprising a chamber delimited by an upper surface and a lower surface, and the solid state lighting lamp according to any embodiment of the present invention as a replacement of the gas discharge lamp. Such a luminaire benefits from the presence of the SSL lamp of the present invention in providing a similar luminous distribution compared to luminaires in which a corresponding gas discharge lamp is fitted, with the benefit of the enhanced lifetime and reduced energy consumption of the SSL lamp compared to the corresponding gas discharge lamp.

The chamber of the luminaire in example embodiments may be further delimited by a housing having a smooth central region centered around said light center, for example to provide an uninterrupted light exit window through which light can exit the luminaire. Such a smooth central region for example may be transparent or translucent. In the context of the present application, a smooth central region is meant to include a region devoid of optical elements that disrupt the surface of the region, such as prisms, facets or the like. In other words, a smooth central region may be a central region that has a continuous surface, similar to a window or the like.

The housing may further comprise an upper region in between the smooth central region and the upper surface, the upper region comprising a first plurality of prisms for shaping incident light of the solid state lighting lamp and a lower region in between the smooth central region and the lower surface, the lower region comprising a second plurality of prisms for shaping incident light of the solid state lighting lamp. Such a luminaire for example may be an acorn luminaire, a post-top luminaire, or the like, in which upper and lower regions of the housing includes prisms to shape the luminous output of the luminaire, e.g. to comply with standardized luminous distributions such as the Type V luminous distribution as specified in the ANSI RP-8-14 roadway lighting standard.

In order to achieve such a compliant luminous distribution, in an embodiment the upper surface and lower surface each comprise a reflector for redirecting incident light towards the luminaire housing.

BRIEF DESCRIPTION OF THE DRAWINGS

Embodiments of the invention are described in more detail and by way of non-limiting examples with reference to the accompanying drawings, wherein FIG. 1 schematically depicts a prior art HPS lamp.

DETAILED DESCRIPTION OF THE EMBODIMENTS

Figure 1:
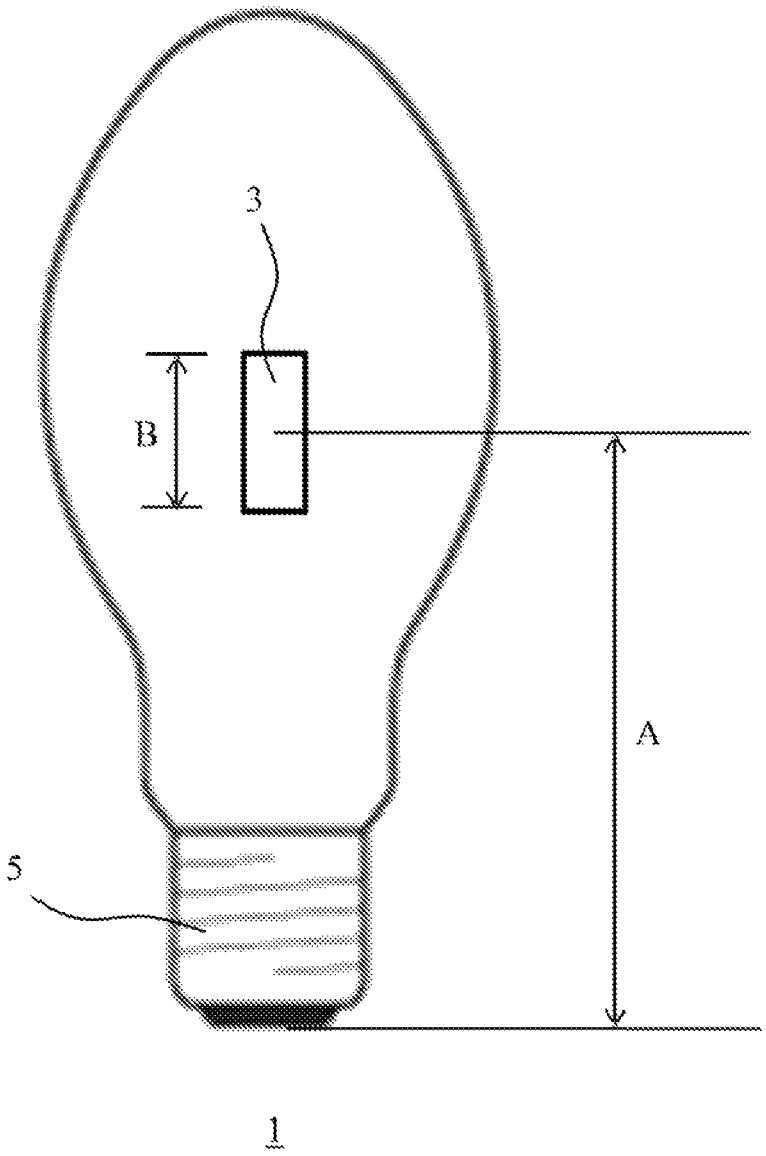
FIG. 1 (PRIOR ART)

It should be understood that the Figures are merely schematic and are not drawn to scale. It should also be understood that the same reference numerals are used throughout the Figures to indicate the same or similar parts.

FIG. 1 schematically depicts a typical gas discharge lamp 1, such as a HPS lamp. The gas discharge lamp 1 typically includes an outer protective envelope surrounding a smaller discharge tube defining a light emission area or burner 3, with a centre of the light emission area 3 being positioned at a distance A from the bottom of the gas discharge lamp 1, e.g. a bottom surface of a fitting 5, which distance A will also be referred to as the light centre length. The diameter of the discharge tube, or width of the light emission area is typically 9 mm. The light emission area 3 has a typical height B, which will also be referred to as the light emission area length B. The light centre length A and light emission area length B, as well as the light emission area itself are typically standardized, i.e. are substantially constant in the various embodiments of gas discharge lamps of a particular type manufactured by different manufacturers.

According to ANSI-ANSLGC78.42-2009 (American National Standard for Electric Lamps—High-Pressure Sodium Lamps), the values of A and B are summarized as below chart:

| | Designation | Light Center Length (LCL, or A, in mm) | Arc Length (or B, in mm) |
|---|---|---|---|
| 35-Watt 52-Volt | S76/O-ZL | 87 ± 5 | 20 ± 4 |
| 50-Watt 52-Volt | S68/O-ZL | 87 ± 5 | 20 ± 4 |
| | S68/O-NV | 127 ± 3 | 20 ± 4 |
| 70-Watt 52-Volt | S62/O-ZL | 87 ± 5 | 27 ± 8 or 17 ± 4 |
| | S62/O-NV | 127 ± 3 | 27 ± 8 or 17 ± 4 |
| 100-Watt 55-Volt | S54/O-ZL | 89 ± 6 | 36 ± 10 or 20 ± 4 |
| | S54/O-NV | 127 ± 3 | 36 ± 10 or 20 ± 4 |
| 150-Watt 55-Volt | S55/O-RV | 93 ± 9 | 40 ± 6 or 23 ± 4 |
| | S55/O-NV | 127 ± 3 | 40 ± 6 or 23 ± 4 |
| 150-Watt 100-Volt | S56/O-KA | 127 ± 3 | 51 ± 11 |
| 200-Watt 100-Volt | S66/O-EJ | 146 ± 3 | 56 ± 11 |
| 250-Watt 100-Volt | S50/O-EJ | 146 ± 3 | 67 ± 9 or 47 ± 4 or 86 ± 8 |
| | S50/O-KA | 127 ± 3 | 67 ± 9 |
| 310-Watt 100-Volt | S67/O-EJ | 146 ± 3 | 69 ± 10 |
| 400-Watt 100-Volt | S51/O-EJ | 146 ± 3 | 75 ± 14 or 57 ± 8 or 102 ± 12 |
| | S51/O-ZC | 178 ± 6 | 75 ± 14 |
| 430-Watt 116-Volt | S145/O-EJ | 146 ± 3 | 75 ± 14 |
| | S145/O-AE | 174 ± 3 | 75 ± 14 |
| 600-Watt 110-Volt | S106/O | 170 ± 8 | 119 ± 3 |
| 750-Watt 120-Volt | S111/O | 178 ± 6 | 128 ± 4 |
| 1000-Watt 250-Volt | S52/O-XB | 222 ± 6 | 222 ± 23 |
| | S52/O-ZC | 178 ± 6 | 126 ± 8 |

Figure 2:
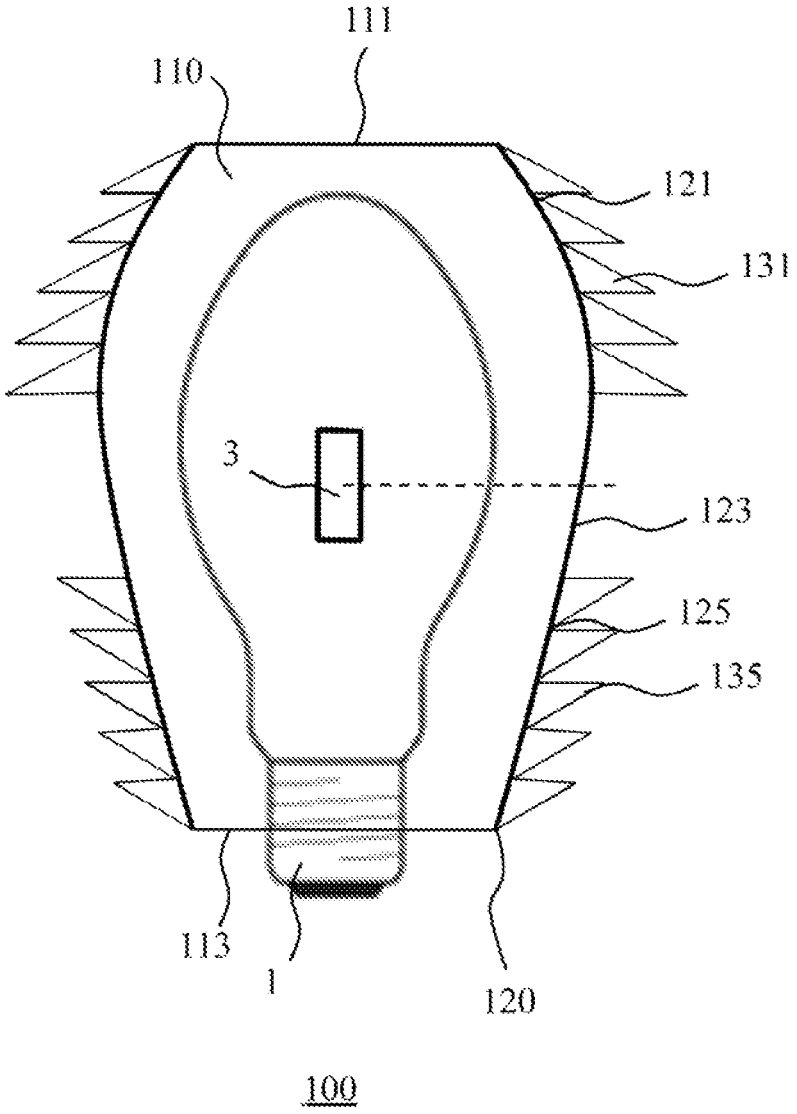
FIG. 2 (PRIOR ART)
FIG. 2 schematically depicts a prior art HPS lamp deployed in a typical luminaire.

Many existing gas discharge luminaires have optical reflectors, lenses and other features that are designed to provide a consistent and predictable illumination pattern which enable lighting designers to reliably design lighting systems for commercial, industrial, municipal and other applications. An example of such a gas discharge luminaire 100 is schematically depicted in FIG. 2, which depicts a cross-section of such a luminaire in which the gas discharge lamp 1 is positioned. The gas discharge luminaire 100 for example may be designed such that upon use of an appropriate gas discharge lamp 1 within the optical chamber 110 of the luminaire 100, the luminaire 100 produces a luminous distribution compliant with a mandatory standard, such as for example a Type V luminous distribution as specified in the ANSI RP-8-14 roadway lighting standard in which the luminaire 100 is designed to produce a 360° luminous distribution to illuminate surrounding area of the luminaire 100. For example, the gas discharge luminaire 100 may be an acorn luminaire or post-top luminaire to be used for outdoor illumination purposes such as pedestrian area illumination or roadside illumination. Such a luminaire 100 may be used in any suitable application domain; for example, where the luminaire 100 is to produce the aforementioned Type V luminous distribution, the luminaire 100 may be used to illuminate areas where a 360° spread of light is desirable, such as parking lots, intersections or more generally large outdoor areas to be illuminated.

The optical chamber 110 of such a gas discharge luminaire 100 for example may be delimited by an upper surface 111 and a lower surface 113, in between which a transmissive housing 120 may be arranged such that light generated in the optical chamber 110 exits the luminaire 100 through the transmissive housing 120. In order to increase the optical efficiency of such a luminaire 100, the upper surface 111 may comprise a reflector for reflecting incident light towards the transmissive housing 120. Similarly, the lower surface 113 may comprise a reflector for reflecting incident light towards the transmissive housing 120. Preferably, at least the upper surface 111 comprises such a reflector. Such a reflector may be made of any suitable material, e.g. may be a metal reflector, a mirror, or the like.

The transmissive housing 120 may be made of any suitable material or combinations of materials that have a suitable optical transmissivity. For example, the transmissive housing 120 may be made of one or more materials selected from glass and optical grade polymers such as polycarbonate, polyethylene terephthalate and poly(methyl methacrylate). The transmissive housing 120 may be shaped such that the luminous distribution generated with an appropriate light source, e.g. an appropriate HPS lamp, within the optical chamber 110 is shaped by the transmissive housing 120 to generate the required luminous distribution.

For example, in the case of a gas discharge luminaire 100 adapted to generate a Type V luminous distribution, the transmissive housing 120 may comprise a central region 123 centered around the light center 3 of the gas discharge lamp 1, as indicated by the dashed horizontal line in FIG. 2. In other words, the center of the central region 123 typically lies at the light center length A from the bottom of the gas discharge lamp 1. Such a smooth central region 123 may act as a lens portion of the transmissive housing 120, comparable to a central region of a Fresnel-type lens. The smooth central region 123 preferably is transparent in order to control the luminous distribution created with the smooth central region 123 although alternatively the smooth central region 123 may be translucent, e.g. diffusive, which has the advantage of reducing glare.

The transmissive housing 120 may further comprise an upper region 121 in between the smooth central region 123 and the upper surface 111 comprising a first plurality of prisms 131 and a lower region 125 in between the smooth central region and the lower surface 113 comprising a second plurality of prisms 135 for shaping incident light generated with the lamp within the optical chamber 110. The upper surface 111 and the lower surface 113 may comprise the same number of prisms although this is not necessarily the case. The prisms 131 and 135 may be used to ensure that the luminous distribution generated with the luminaire 100 has the desired shape, e.g. to prevent too much light straying beyond virtual planes coinciding with the upper and lower surfaces 111, 113 as will be immediately apparent to the skilled person. For example, the prisms 131 and 135 may be used to ensure that the overall luminous distribution generated with the luminaire 100 complies with a relevant mandatory standard as previously explained.

Figure 3:
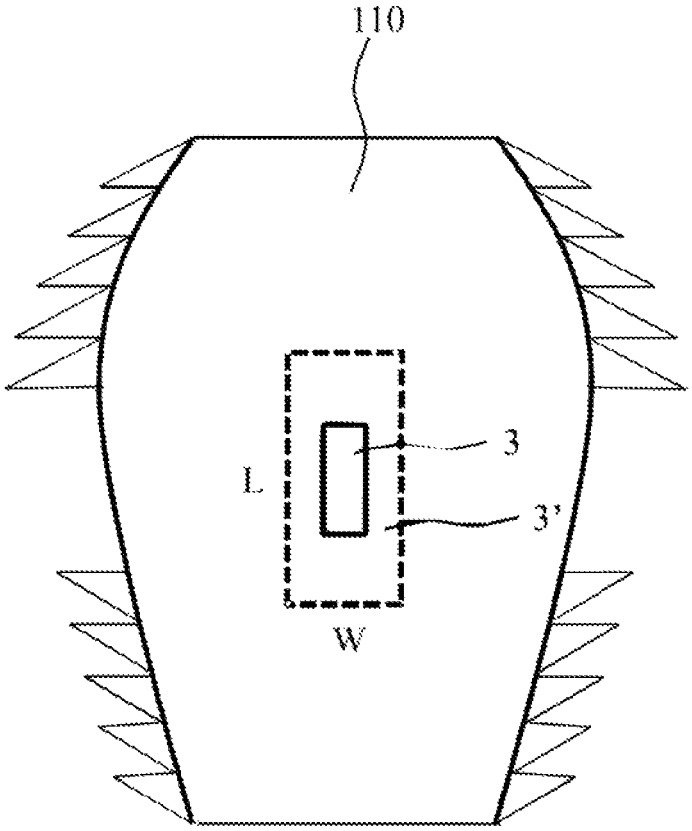
FIG. 3 schematically depicts a comparison between an aspect of the prior art HPS lamp and a corresponding aspect of a replacement SSL lamp.

It is desirable to replace the gas discharge lamp 1 intended for use in such a luminaire 100, e.g. a target HPS lamp, with a SSL lamp as explained in more detail above. However, as schematically depicted in FIG. 3, in order to achieve a comparable luminous flux, the SSL lamp typically has a light emission area 3' with a light center length L and width W, as defined by the plurality of SSL sources distributed across the SSL lamp that is substantially larger than the light emission area 3 of the gas discharge lamp 1. Consequently, when such a replacement SSL lamp is fitted within the optical chamber 110 of the luminaire 100, a common problem is that the SSL lamp generates a luminous distribution that is significantly different to the luminous distribution generated with the originally intended gas discharge lamp 1, such that the optical function implemented by the transmissive housing 120 no longer generates the desired luminous distribution with the luminaire 100.

Figure 4:
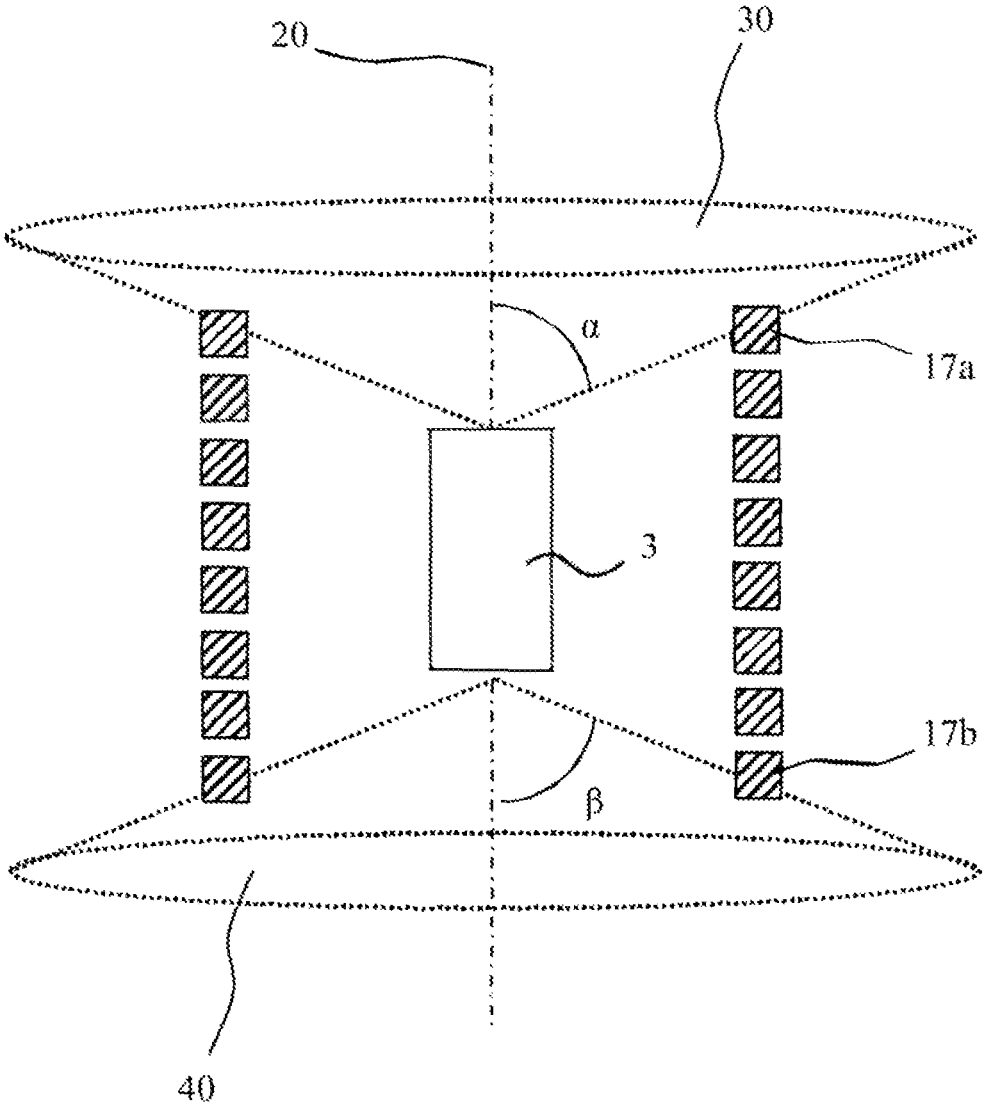
FIG. 4 schematically depicts a detail of a SSL lamp for replacing a prior art HPS lamp according to an example embodiment.
Figure 5:
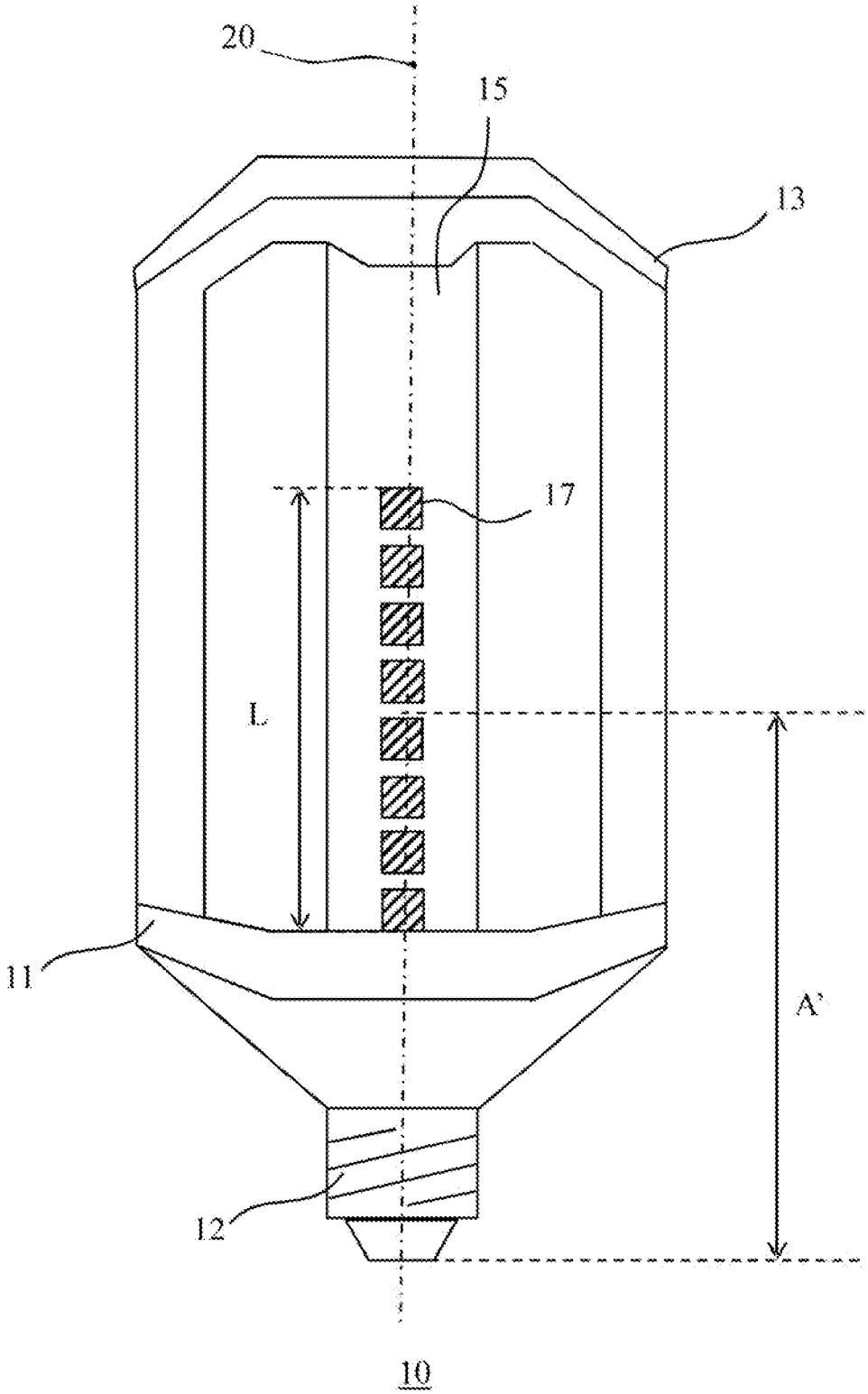
FIG. 5 schematically depicts a SSL lamp for replacing a prior art HPS lamp according to an example embodiment.

Embodiments of the present invention provide a SSL lamp for replacing a target gas discharge lamp 1 that produces a luminous distribution that is similar enough to that of the target gas discharge lamp 1 such that when the SSL lamp is used in the luminaire 100, the luminaire 100 still produces a luminous distribution compliant with a relevant standard such as a Type V luminous distribution as specified in the ANSI RP-8-14 roadway lighting standard in some embodiments. The inventors have realized that by careful positioning of linear arrays of SSL sources on the outer surface of the SSL lamp such that these linear arrays align with the central axis of the SSL lamp, the luminous distribution of the target gas discharge lamp 1 to be replaced by the SSL lamp may be accurately mimicked. This will be explained in more detail with the aid of FIG. 4, which schematically depicts the positioning of the arrays of SSL sources relative to the light emission area 3 of the target gas discharge lamp 1 and the central axis 20 of the SSL lamp 10, and FIG. 5, which schematically depicts a perspective view of a SSL lamp 10 according to an example embodiment.

In order to accurately mimic the luminous distribution of the target gas discharge lamp 1, each array of SSL sources 17 is to be positioned such that a central point of each array lies at a distance A' from the bottom of the connector 12 of the SSL lamp 10, which distance A' lies within 10% tolerance of the given light center length A of the gas discharge lamp 1 to be replaced. Preferably, the central point of each array lies within 5% tolerance of this given light center length A. This ensures that each linear array of SSL sources 17 has a light emission center that at least approximately coincides with the light emission center of the light emission area 3 of the target gas discharge lamp 1 it seeks to replace.

In addition, the upper solid state lighting source 17*a* of each linear array, i.e. the solid state lighting source distal to the connector 12, is positioned on an upper virtual conical surface 30 extending from the point on the central axis 20 coinciding with an upper edge of the light emission area 3 of the target gas discharge lamp 1. The upper virtual conical surface 30 is defined by having a first internal angle $\alpha$ with the central axis 20 in a range 40-85°, and preferably in a range of 77-83°. The lower solid state lighting source 17*b* of each linear array, i.e. the solid state lighting source proximal to the connector 12, is positioned on a lower virtual conical surface 40 extending from the further point on the central axis 20 coinciding with a lower edge of the light emission area 3 of the target gas discharge lamp 1. The lower virtual conical surface 40 is defined by having a second internal angle $\beta$ with the central axis 20 in a range 40-85° and preferably in a range of 77-83°. In an embodiment, the first internal angle $\alpha$ and the second internal angle $\beta$ may have the same absolute value, i.e. may be identical, in which case the central point of each linear array of SSL sources 17 lies at the light center length A from the connector 12 of the SSL lamp 10, i.e. A=A'. When the above design rules for the positioning of the linear arrays of SSL sources 17 are obeyed, the SSL lamp 10 exhibits a luminous distribution that closely resembles the luminous distribution of the gas discharge lamp 1 it seeks to replace.

The linear arrays of SSL sources 17 may be positioned on a body, which body may be made of a thermally conductive material such as a metal or metal alloy such that the body may act as a heatsink for the SSL sources 17. The SSL sources 17 may be directly positioned on the thermally conductive material or may be positioned on a carrier such as a PCB or the like, which carrier is subsequently mounted on the body such that the linear arrays of SSL sources 17 on each carrier are positioned in accordance with the above design rules. Any suitable type of SSL source 17, e.g. any suitable type of LED, may be deployed in such a SSL lamp 10. In an embodiment, the body is made of aluminium, which is a particularly suitable material because of its low cost and high pliability, which facilitates the shaping of the body. In an example embodiment, the body may comprise a plurality of elongate channels 15 along the central axis 20 of the SSL lamp 10, with each linear array of SSL sources 17 mounted in one of the channels 15. Such channels 15 for instance may be used to further shape the luminous distribution of the SSL lamp 10, for example by making at least the sidewalls of such channels 15 reflective.

Each linear array may have a total length L, which total length L may exceed the light emission area length B of the target gas discharge lamp 1 to be replaced by at least 30% in some embodiments. In such embodiments, the SSL lamp 10 may have a substantially larger cross-section than the target gas discharge lamp 1 to be replaced, whilst still producing a comparable luminous distribution to the gas discharge lamp 1.

The connector 12 may form part of a base portion 11 of the SSL lamp 10 and may be any suitable type of connector, e.g. an Edison fitting, a bayonet fitting, and so on. The SSL lamp 10 may further comprise an upper portion 13 opposite the base portion 11, with the linear arrays of SSL sources 17 extending between these opposing portions 11, 13 in parallel with the central axis 20 of the SSL lamp 10.

Figure 6:
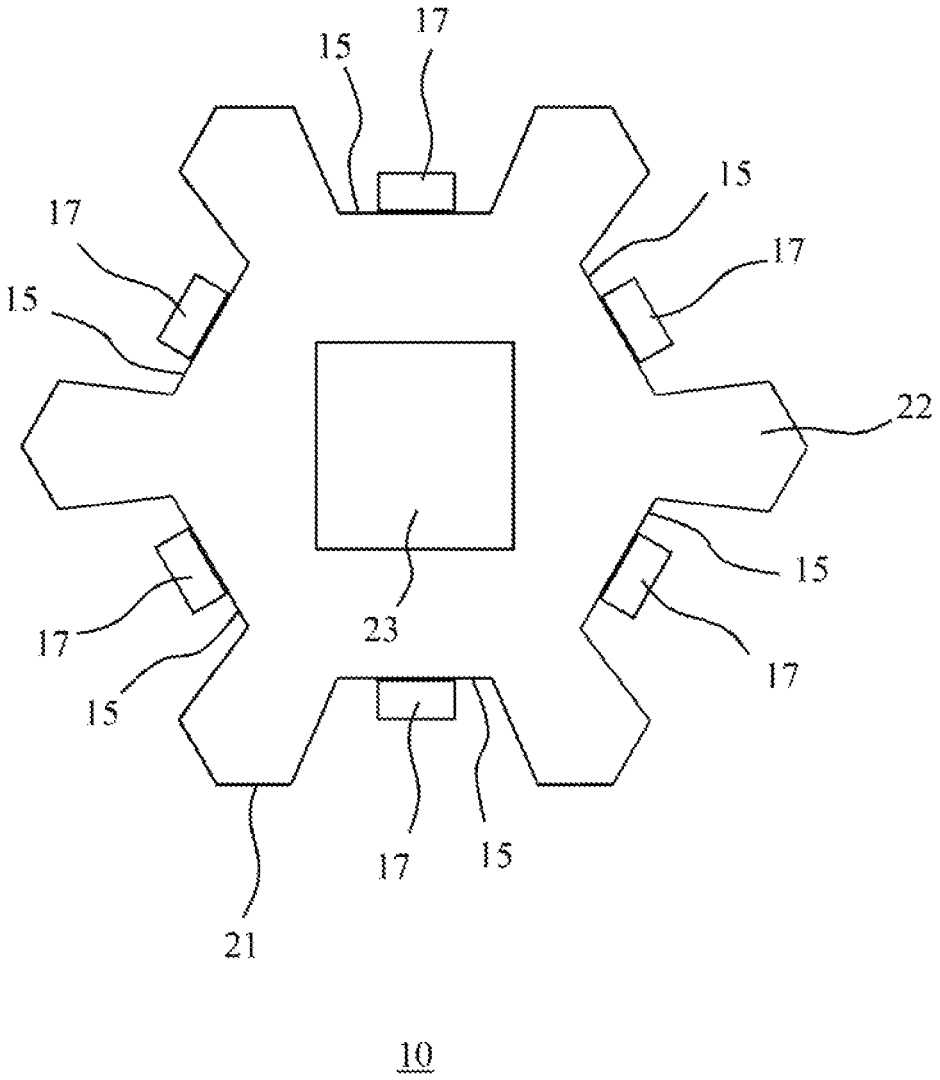
FIG. 6 schematically depicts a cross-sectional view of a SSL lamp for replacing a prior art HPS lamp according to an example embodiment.
Figure 7:
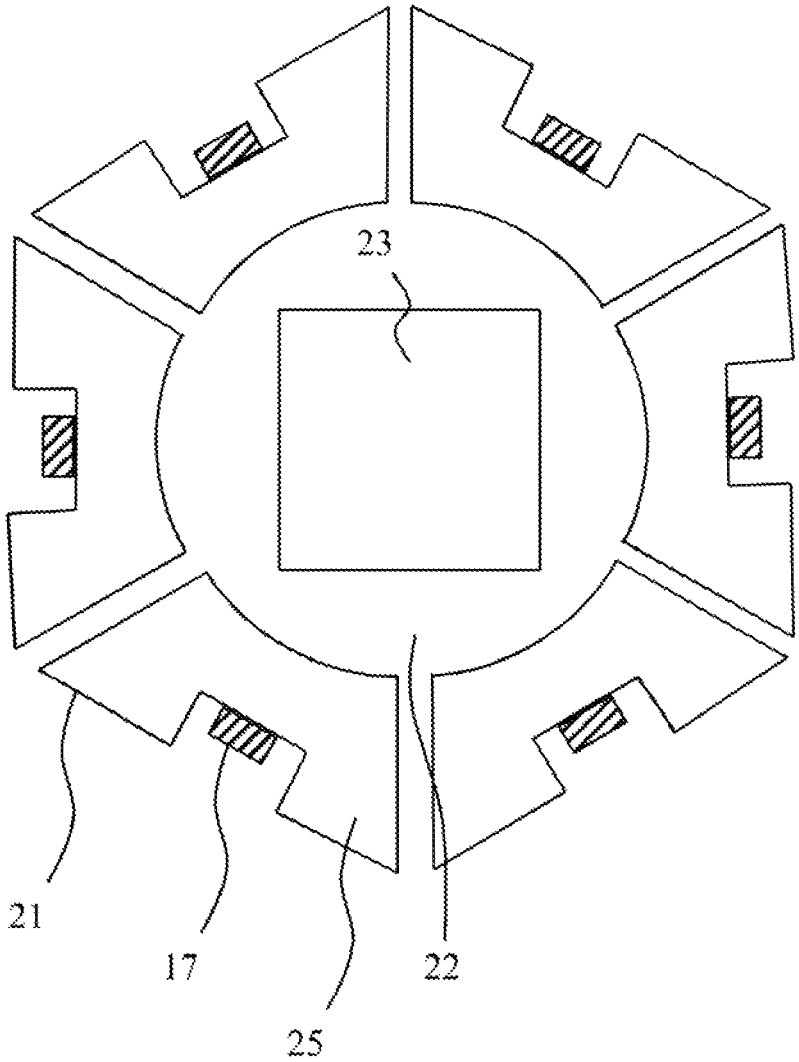
FIG. 7 schematically depicts a cross-sectional view of a SSL lamp for replacing a prior art HPS lamp according to another example embodiment.

FIG. 6 schematically depicts a cross-sectional view of a SSL lamp 10 according to an example embodiment in which the respective linear arrays of SSL sources 17 are mounted on a single body 21 delimiting an inner volume 22. It is noted for the avoidance of doubt that the respective linear arrays of SSL sources 17 are positioned in channels 15 of the body 21 by way of non-limiting examples only as previously explained. The inner volume 22 within the single body 21 may be utilized to house electrical components such as a ballast or driver circuit 23 for the SSL sources 17. In a particularly advantageous alternative embodiment, which is schematically depicted in FIG. 7, the body 21 is formed by separate modules 25 designed to engage with each other in order to form the body 21, which facilitates the assembly of the body 21, thereby reducing the manufacturing cost of the SSL lamp 10.

At this point, it is noted that the SSL lamp 10 may comprise any suitable number of linear arrays of SSL sources 17, and that each linear array may comprise any suitable number of SSL sources 17. In a non-limiting example, the SSL lamp 10 comprises six linear arrays each comprising ten SSL sources 17, e.g. mid-power LEDs, but other arrangements, i.e. different number of linear arrays and/or linear arrays comprising a different number of SSL sources 17 are equally feasible.

Figure 8:
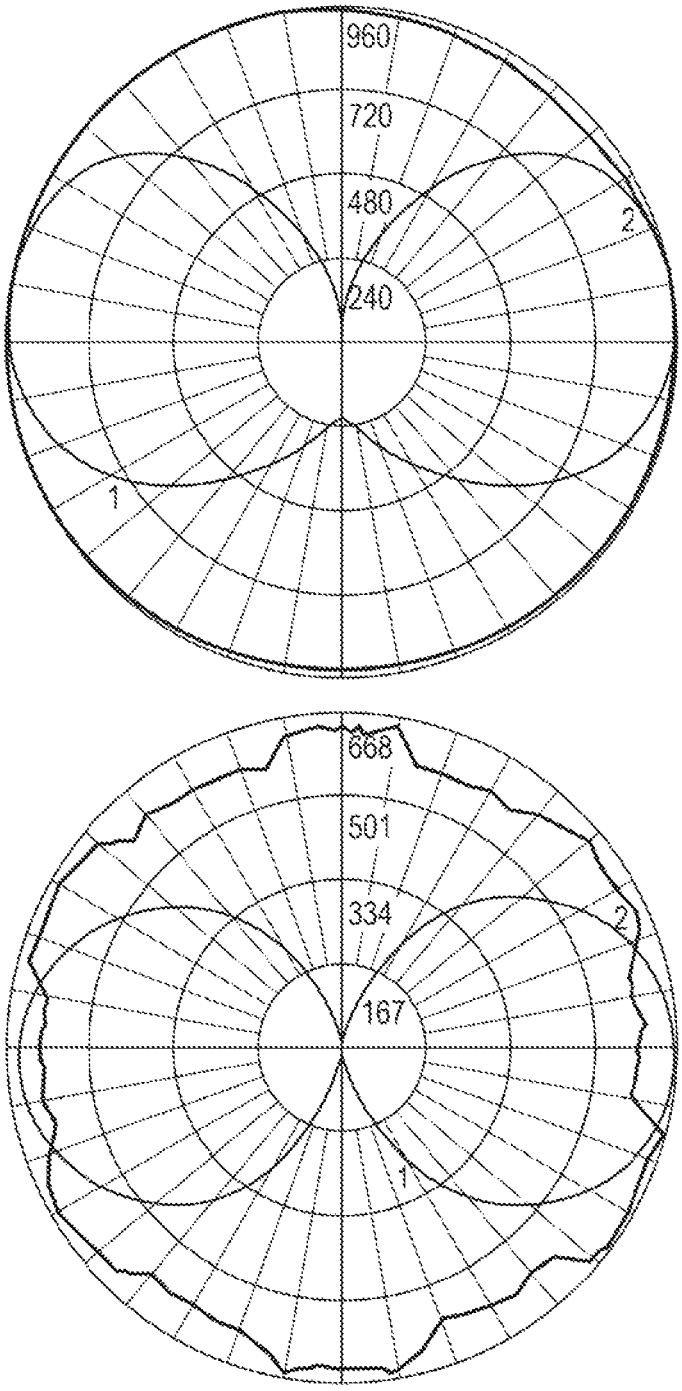
FIG. 8 depicts polar plots of the luminous distribution of a prior art HPS lamp (top plot) and a replacement SSL lamp according to an embodiment of the present invention (bottom plot)

FIG. 8 is a comparison between a polar plot of a luminous distribution of a target gas discharge lamp 1 (top plot) and a polar plot of a luminous distribution of a SSL lamp 10 according to an embodiment of the present invention (bottom plot). It will be immediately apparent that the respective luminous distributions are strikingly similar, thereby indicating that the SSL lamp 10 designed in accordance with the aforementioned design rules produces a luminous distribution that closely resembles the luminous distribution of the gas discharge lamp 1 it seeks to replace (here a HPS lamp).

Figure 9:
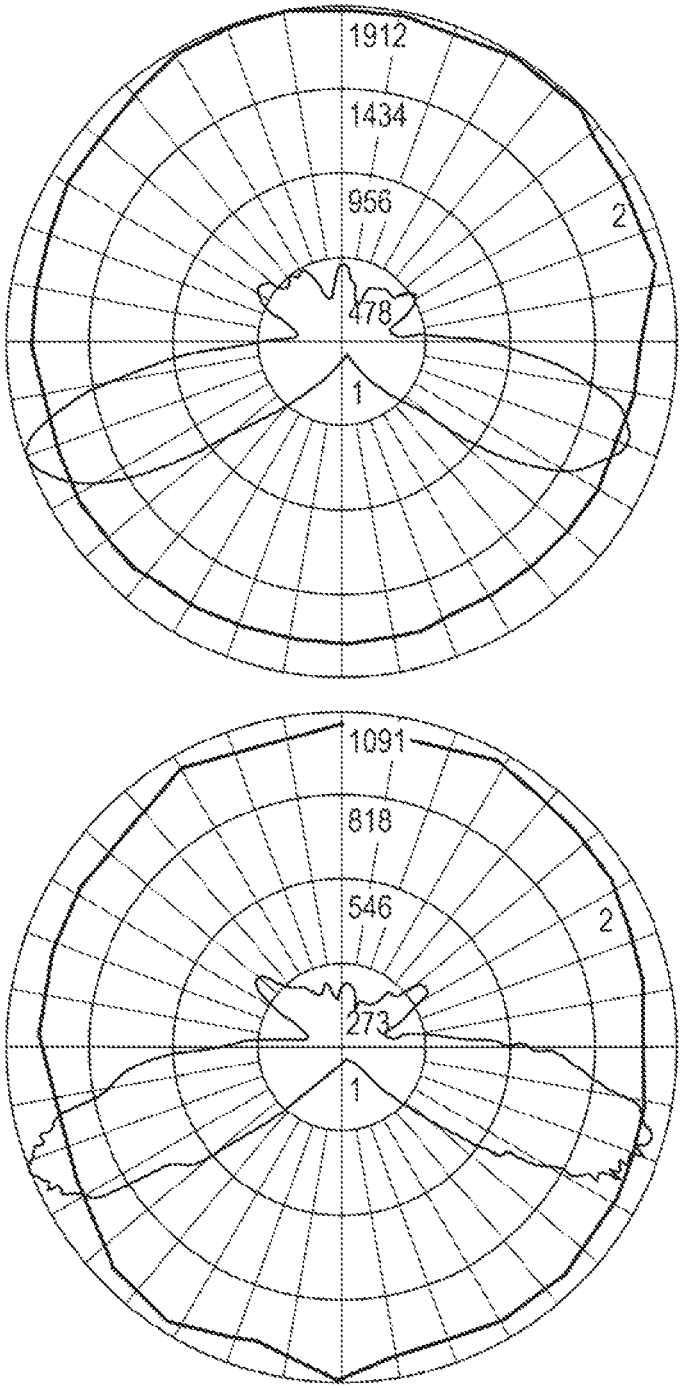
FIG. 9 depicts polar plots of the luminous distribution of a prior art HPS lamp (top plot) and a replacement SSL lamp according to an embodiment of the present invention (bottom plot) when fitted in a particular type of luminaire.

This is further demonstrated with the aid of FIG. 9, which depicts a comparison between a polar plot of a luminous distribution of a gas discharge luminaire 100 including the target gas discharge lamp 1 (top plot) and a polar plot of a luminous distribution this luminaire 100 in which the gas discharge lamp 1 is replaced by a SSL lamp 10 according to an embodiment of the present invention (bottom plot). A high degree of similarity between the top and bottom plot is immediately apparent, thereby demonstrating that the SSL lamp 10 according to embodiments of the present invention may replace a gas discharge lamp 1 in such a gas discharge luminaire 100 whilst retaining the desired or required optical performance of such a luminaire.

It should be noted that the above-mentioned embodiments illustrate rather than limit the invention, and that those skilled in the art will be able to design many alternative embodiments without departing from the scope of the appended claims. In the claims, any reference signs placed between parentheses shall not be construed as limiting the claim. The word "comprising" does not exclude the presence of elements or steps other than those listed in a claim. The word "a" or "an" preceding an element does not exclude the presence of a plurality of such elements. The invention can be implemented by means of hardware comprising several distinct elements. In the device claim enumerating several means, several of these means can be embodied by one and the same item of hardware. The mere fact that certain measures are recited in mutually different dependent claims does not indicate that a combination of these measures cannot be used to advantage.

The invention claimed is:

1. A solid state lighting lamp for replacing a gas discharge lamp having a light emission area with a given light center length (A) and a given light emission area length (B), the solid state lighting lamp comprising:

a base portion including a connector;

an upper portion opposite said base portion; and a plurality of linear arrays of solid state lighting sources mounted on a body and extending in parallel with a central axis of the lamp, each linear array having a central point within 10% tolerance of the given light center length (A) from the connector, wherein, for each linear array:

an upper solid state lighting source lies on an upper virtual conical surface extending from a point of said central axis coinciding with an upper edge of the light emission area under a first internal angle (α) between said central axis and the upper virtual conical surface in a range 40-85°; and a lower solid state lighting source lies on a lower virtual conical surface extending from a further point of said central axis coinciding with a lower edge of the light emission area under a second internal angle (β) between said central axis and the lower virtual conical surface in a range 40-85°;

wherein the distance between the point and the further point of said central axis is the given light emission area length (B).

2. The solid state lighting lamp of claim 1, wherein the first internal angle (α) and the second internal angle (β) are individually selected from a range of 77-83°.

3. The solid state lighting lamp of claim 1, wherein the first internal angle (α) and the second internal angle (β) are the same.

4. The solid state lighting lamp of claim 1, wherein each linear array has a central point within 5% tolerance of the given light center length (A) from the connector.

5. The solid state lighting lamp of claim 1, wherein each linear array has a length exceeding the given light emission area length by at least 30%.

6. The solid state lighting lamp of claim 1, wherein the body is formed of separate optical modules, each carrying one of said linear arrays.

7. The solid state lighting lamp of claim 1, wherein the body is made of a thermally conductive material and arranged to act as a heat sink for the solid state lighting sources.

8. The solid state lighting lamp of claim 7, wherein the thermally conductive material is aluminium.

9. The solid state lighting lamp of claim 1, wherein the body delimits an inner volume of the solid state lighting lamp, said inner volume comprising a driver circuit for the solid state lighting sources.

10. The solid state lighting lamp of claim 1, wherein the body comprises a plurality of channels, each linear array of solid state lighting sources being mounted in one of said channels.

11. A luminaire for use with a gas discharge lamp having a given light center length (A) and a given light emission area length (B), the luminaire comprising:

a chamber delimited by an upper surface and a lower surface, and the solid state lighting lamp of claim 1 as a replacement of the gas discharge lamp.

12. The luminaire of claim 11, wherein the chamber is further delimited by a housing having a smooth central region centered around said light center.

13. The luminaire of claim 12, wherein the smooth central region is transparent or translucent.

14. The luminaire of claim 12, the housing further comprising:

an upper region in between the smooth central region and the upper surface, the upper region comprising a first plurality of prisms for shaping incident light of the solid state lighting lamp; and a lower region in between the smooth central region and the lower surface, the lower region comprising a second plurality of prisms for shaping incident light of the solid state lighting lamp.

15. The luminaire of claim 11, wherein at least one of the upper surface and the lower surface comprises a reflector.

* * * * *